United States Patent [19]

Scholl et al.

[11] 4,347,797

[45] Sep. 7, 1982

[54] SEWING DEVICE FOR PRODUCING FASTENING STITCHES AND TACK STITCHES

[75] Inventors: Hans Scholl, Oerlinghausen-Lipperreihe; Jochen Fischer, Bielefeld, both of Fed. Rep. of Germany

[73] Assignee: Kochs Adler AG, Bielefeld, Fed. Rep. of Germany

[21] Appl. No.: 215,238

[22] Filed: Dec. 10, 1980

[30] Foreign Application Priority Data

Jan. 11, 1980 [DE] Fed. Rep. of Germany ..... 3000831

[51] Int. Cl.[3] ..... D05B 21/00

[52] U.S. Cl. ..... 112/121.12; 112/121.15

[58] Field of Search ..... 112/121.12, 121.15, 112/121.11, 73, 70, 158 R, 158 E

[56] References Cited

U.S. PATENT DOCUMENTS

| | | | |
|---|---|---|---|
| 3,543,737 | 12/1970 | Maschmann | 112/121.12 |
| 3,830,175 | 8/1974 | Levor | 112/121.12 |
| 3,983,825 | 10/1976 | Dobner et al. | 112/121.12 |
| 4,160,423 | 7/1979 | Scholl et al. | 112/121.12 |
| 4,282,819 | 8/1981 | Sartor | 112/121.12 |

*Primary Examiner*—H. Hampton Hunter

*Attorney, Agent, or Firm*—Max Fogiel

[57] ABSTRACT

A sewing device for producing fastening stitches and tack stitches in a workpiece is described, in which a sewing head is installed with a jogging mechanism laterally vibrating the reciprocating needle as to perform a zig-zag movement or a needle-feed movement while a continuous relative feed movement between the workpiece and the needle is produced by a control device. The control device includes means for maintaining the direction of the needle vibration and the feed movement, as the fastening stitches are produced.

10 Claims, 19 Drawing Figures

Fig.1
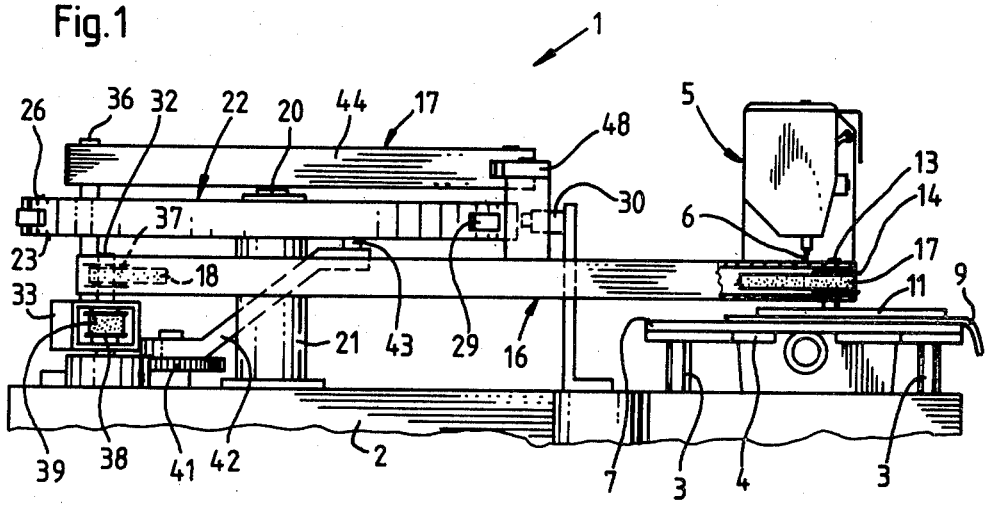
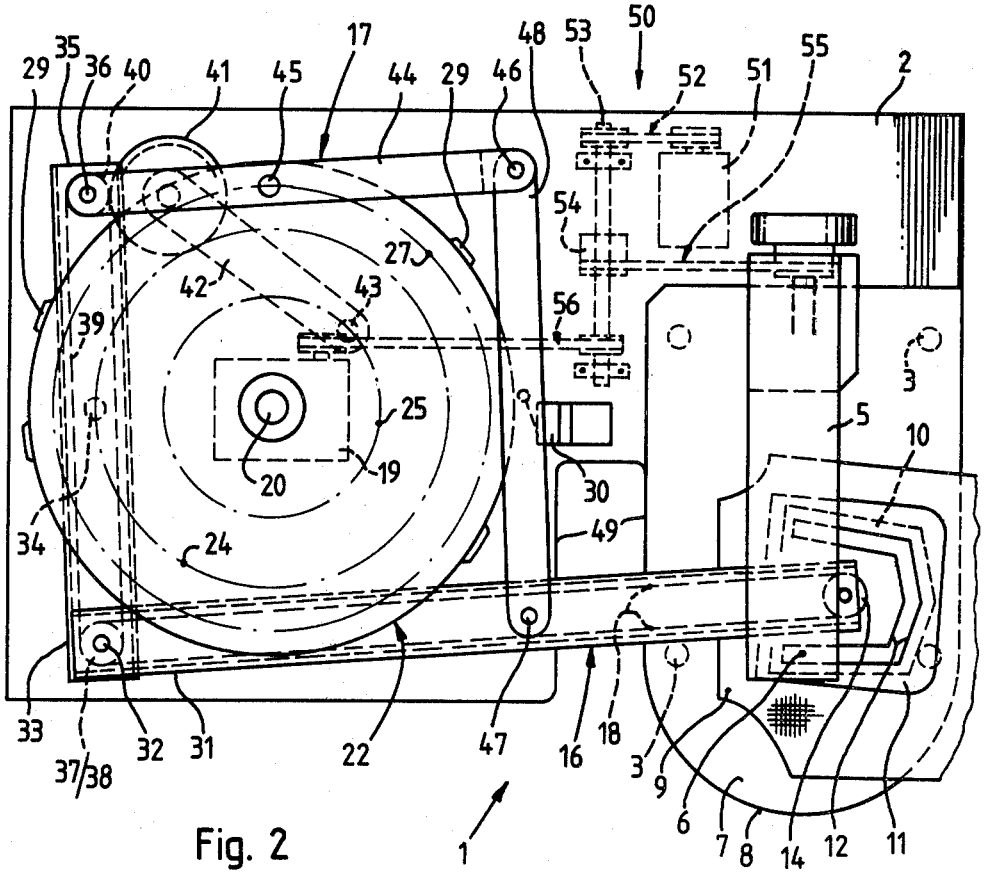
Fig. 2

Fig. 6
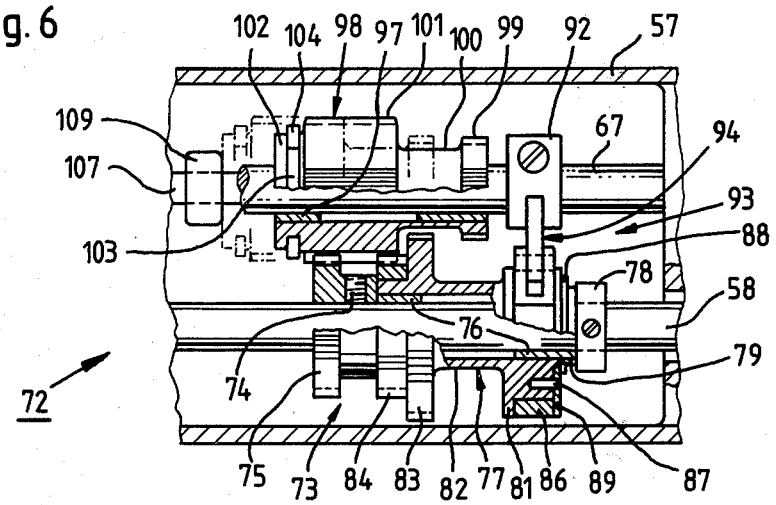
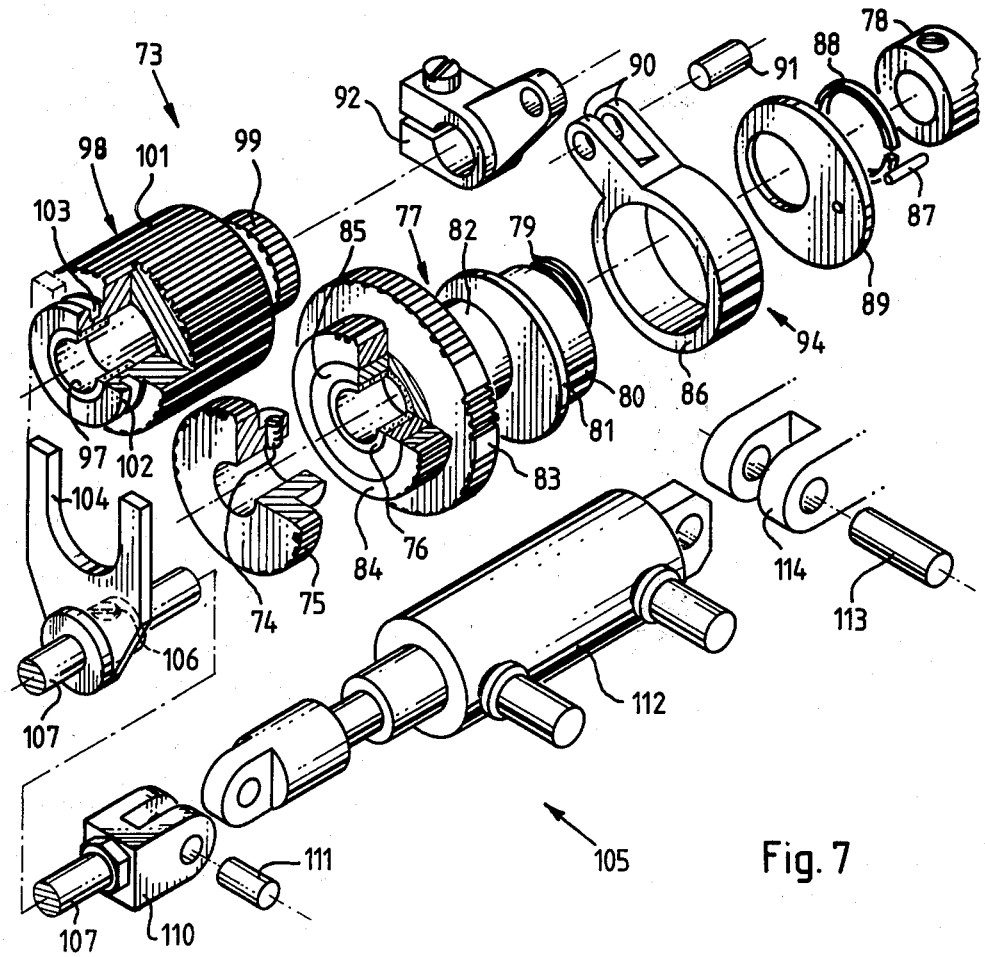
Fig. 7

Fig. 8
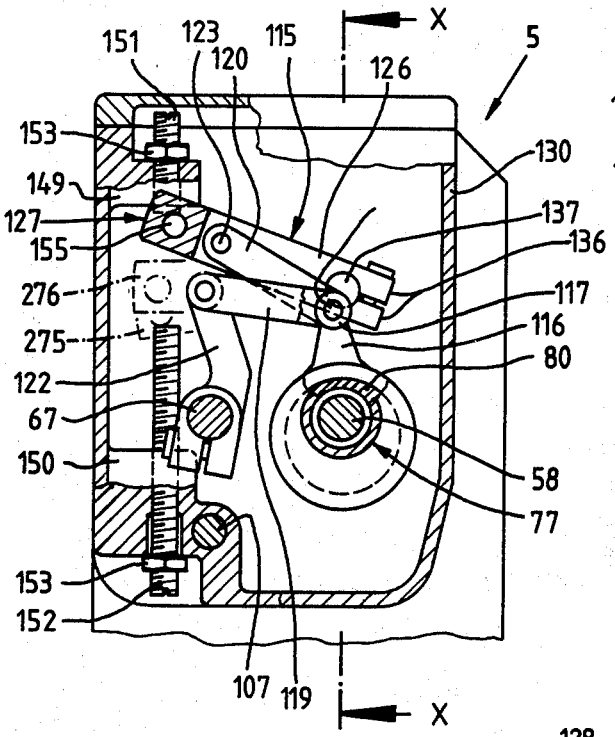
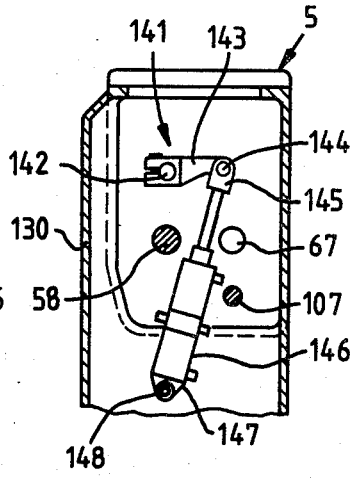
Fig. 11
Fig. 9
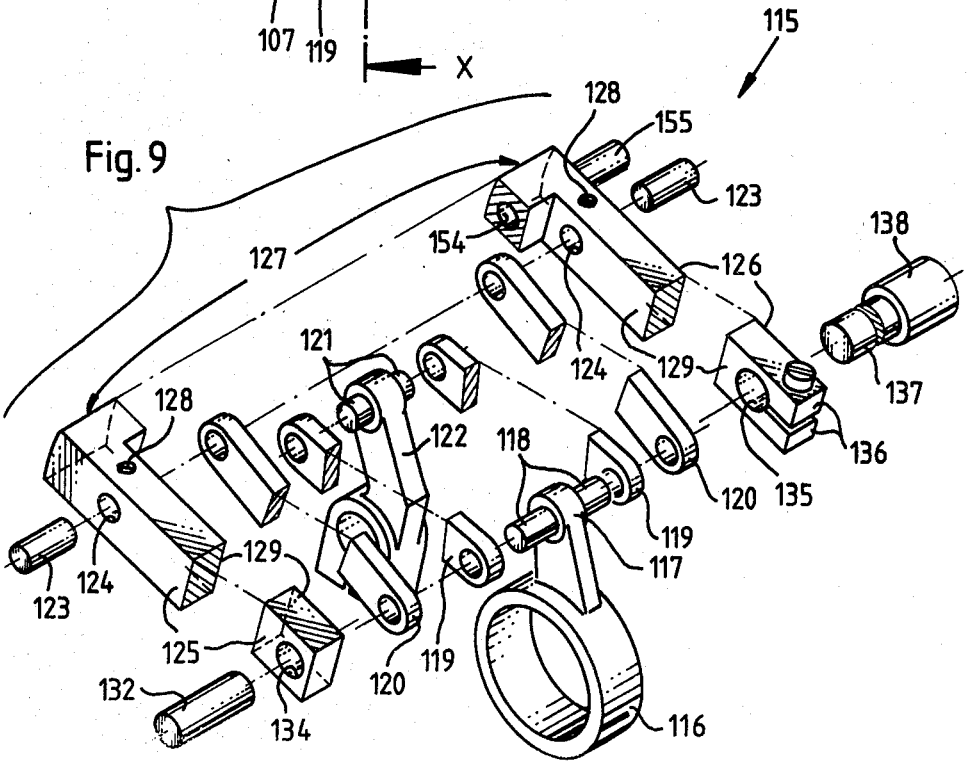

SEWING DEVICE FOR PRODUCING FASTENING STITCHES AND TACK STITCHES

BACKGROUND OF THE INVENTION

The present invention generally relates to a sewing device for producing a stitch row having fastening stitches and tack stitches, which, in particular, are of a bar tack configuration produced by means of zig-zag stitching.

In the U.S. Pat. No. 3,983,825 there is described a method and an apparatus for sewing a pocket cut on a workpiece, at which both pieces are clamped by a workpiece clamping mechanism and relatively moved to the needle of a sewing machine performing both, fastening and tack stitches. Due to different feed directions of the workpieces in relation to the stitch forming elements such as needle and looptaker, there are unconstant conditions as the needle thread and the looptaker thread are pulled off, which causes a variation of the thread tensions, i.e. a well appearing stitching for decorative applications can't be produced.

In order to eliminate the described problem, a method and an apparatus for forming normally appearing stitches was published in the U.S. Pat. No. 3,827,382, at which the value of the needle-thread-tension is altered depending on the direction of the relative feed motion between the workpiece and the stitch forming elements.

The above cited sewing devices operate with a continuous feeding movement which in addition to the variation of thread tension causes difficulties. Depending on the feed direction the needle is exposed to differently directed lateral forces acting on the needle, which effects the loop formation of the needle thread as well as the action of the looptaker and also creates problems as to promote the formation of a burr at the needle and/or wearing the beak of the looptaker due to collision of both elements.

In the U.S. Pat. No. 4,088,085 it is proposed to equip such type of sewing device with a movable needle guide as to eliminate the described problem connected to wear of the needle and/or looptaker, which reduces the productivity of such sewing device. The described needle guide requires an expensive and complicated drive mechanism and a special control on one hand and only protects needle and looptaker against collision on the other hand. In the operation of producing stitches in stiffer materials such as leather or plastic the described needle guide causes an elongation of the hole in the material being perforated by the needle as the workpiece is exposed to additional stresses. Since the dimension of workpiece feed as the needle penetrates the workpiece is proportionally to the stitch length, the producable stitch length at such sewing devices is restricted to a value of about 2.5 to 3 mm.

According to the U.S. Pat. No. 4,157,686 a sewing device of the described kind may be equipped with a special drive system performing the feed movement of the work holder in relation to the needle of the sewing machine, at which the feed movement is of intermittent character as to eliminate lateral forces deflecting the needle while penetrating the workpiece and thus eliminating sewing problems. The proposed work holder drive system requires a special planetary gear, which either is free of any back lash or liberated of any back lash by means of additional components. Due to the superimposition of a continuous and an oscillating movement the total mechanical structure of the sewing device is exposed to vibrations, which finally interfer with the movements of the work holder, so that the lateral needle deflection can't be totally eliminated.

SUMMARY OF THE INVENTION

It is a main object of the present invention to create a sewing device for producing fastening stitches and tack stitches, at which the relative feed movement between the sewing machine's needle and the workpiece is of a continuous character and at which the needle is not exposed to lateral forces while performing the fastening stitches.

Another object of the invention is to provide a sewing device for producing tack stitches and fastening stitches of a contoured profile, at which the feed direction between the workpiece and the stitch forming elements is maintained constantly while performing the fastening stitches.

Still another object of the invention is to create a sewing device, which is capable of performing tack stitches and fastening stitches of larger stitch lengths and still of a high quality as required for decorative stitching operations, as an example.

A further object of the present invention is to create a sewing device having a sewing head which is simple in design and reliable in operation.

Other objects, advantages and features of the invention will appear from the detailed description of various embodiments which will now be explained in conjunction with the drawings.

BRIEF DESCRIPTION OF THE DRAWINGS

FIG. 1 is a front elevation of an automatic sewing device;

FIG. 2 is a top plan view of the automatic sewing device;

FIG. 6 is a partial sectional top plan view of the gear taken along line VI—VI of FIG. 5;

FIG. 7 is a perspective exploded view of an embodiment 1 showing the essential parts of the gear;

FIG. 8 is a view corresponding to FIG. 5 representing a modified gear according to the embodiment 1, at which the shift gear is omitted;

FIG. 9 is a perspective exploded view of the essential parts of the modified gear;

FIG. 11 is a section taken along line XI—XI of FIG. 3 showing an arm carrying an adjustable drive according to the modified embodiment 1;

DESCRIPTION OF THE PREFERRED EMBODIMENTS

Figure 3:
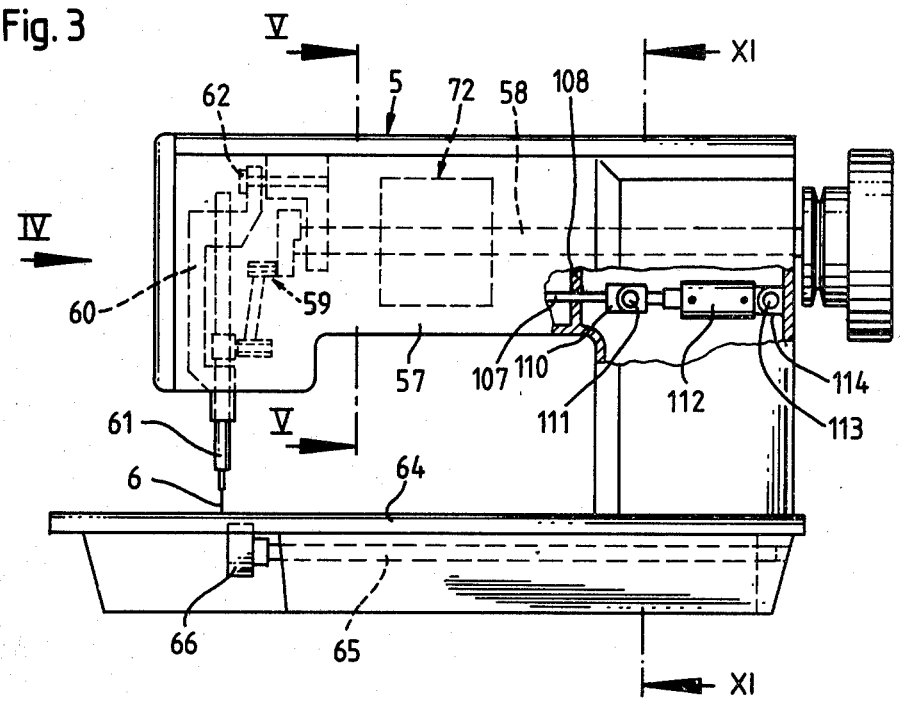
FIG. 3 is a front elevation of a sewing head of the automatic sewing device on an enlarged scale.

Referring to FIG. 1, there is illustrated an automatic sewing device 1 mounted on a stand 2 having a plate 4, which is fastened thereto by means of posts 3 for receiving a sewing head 5 with a needle 6. On the plate 4 there is arranged a workpiece supporting plate 7 extending with a semicircled portion 8 around the needle 6 of the sewing head 5 (FIG. 2). On the workpiece supporting plate 7 there is clamped a workpiece cut 9 and a pocket cut 10 by means of a clamping plate 11 having an U-shaped recess 12. According to FIG. 1, the clamping plate 11 is installed with a shaft 13 and a belt pulley 14, at which the shaft 13 is pivoted in one end 15 of a square-formed tubular arm 16 of a guiding device 17 and angularly positioned by a timing belt 18 cooperating with the belt pulley 14.

Within the stand 2 there is arranged a gear 19, a vertical shaft 20 of which is pivoted in a tube 21 and carrying a control cam 22 (FIGS. 1 and 2) provided at its lower surface 23 with two grooves 24, 25, at its upper surface 26 with a groove 27 and at its periphery 28 with a cam 29 cooperating with a switch 30.

The other end 31 of the arm 16 of the guiding device 17 is linked by means of a shaft 32 to a lever 33 which carries a cam follower 34 cooperating with the groove 24. The free end 35 of the lever 33 is pivoted to an axis 36 of the stand 2. On the shaft 32 there is mounted a belt pulley 37 receiving the timing belt 18. A further belt pulley 38 is arranged within the rocking lever 33 cooperating with a timing belt 39 and a belt pulley 40 pivoted on the axis 36. The belt pulley 40 is provided with a not shown gear wheel which meshes with a gear wheel 41 located at a lever 42 pivoted at the stand 2. The lever 42 carries a cam follower 43 cooperating with the groove 25 of the control cam 22.

The axis 36 receives another rocking lever 44 provided with a cam follower 45 projecting into the groove 27 of the control cam 22. The free end of the rocking lever 44 is linked to the tubular arm 16 by means of bolts 46, 47 and a connecting bar 48.

The stand 2 is formed with a recess 49 and provided with a drive mechanism 50. A motor 51 drives a shaft 53 via a belt drive 52. The shaft 53 is drivingly connected to the sewing head 5 by means of a clutch 54 and a belt drive 55. Furthermore, the shaft 53 is connected to the gear 19 by means of a belt drive 56.

Figure 4:
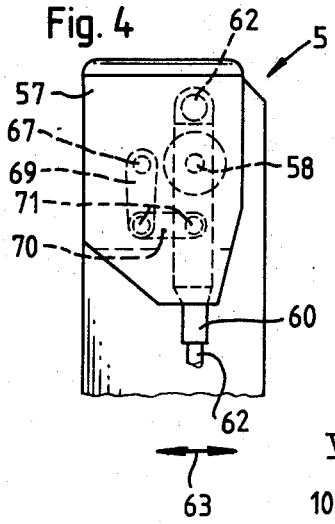
FIG. 4 is a side elevation of the sewing head in the direction of arrow IV in FIG. 3.
Figure 15:
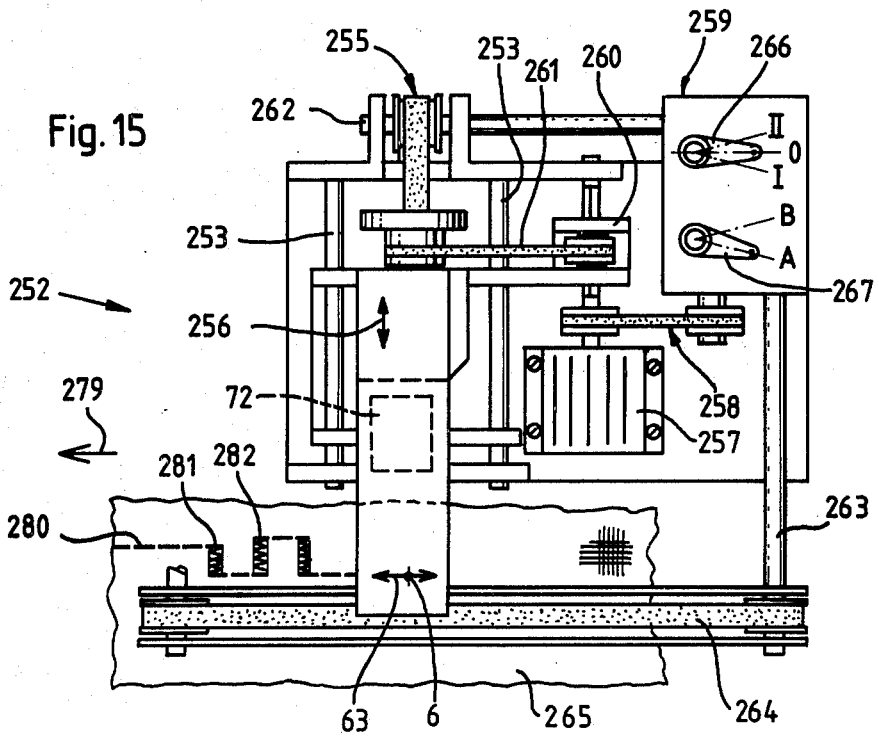
FIG. 15 represents an other automatic sewing device.

As illustrated in FIGS. 3 and 4, an arm 57 of the sewing head 5 receives an arm shaft 58 which terminates in a crank mechanism 59 for reciprocately driving a needle bar 61 pivoted in a bracket 60. The bracket 60 is hinged on a bolt 62 secured to the arm 57, which is extendung parallelly to the arm shaft 58, thus allowing the bracket 60 to laterally jog into a direction 63 as illustrated in FIGS. 4 and 15. As obvious from FIG. 3, the sewing head 5 is further provided with a base plate 64 receiving a looptaker 66, and a shaft 65 which is connected to the arm shaft 58 by means of a not shown drive. Moreover, a rocking shaft 67 (FIG. 4) extending parallelly to the arm shaft 58, is pivoted in the arm 57. A link 70 connects the bracket 60 by means of bolts 71 with a crank 69 fastened to the rocking shaft 67, which terminates in a gear 72 (FIG. 3).

EMBODIMENT 1

Figure 5:
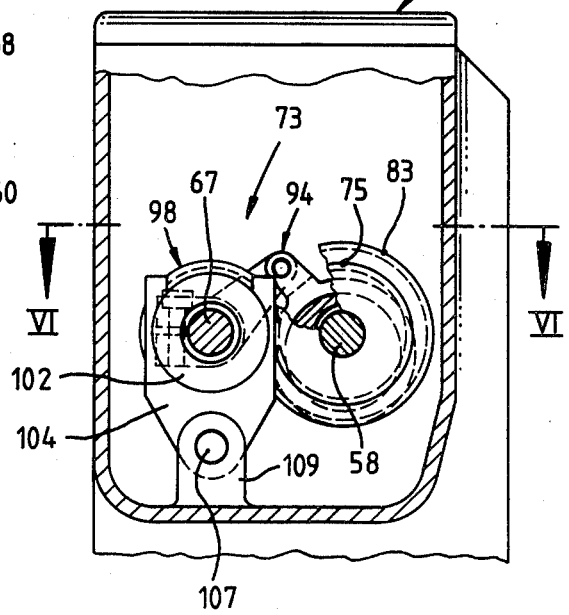
FIG. 5 is an enlarged sectional view taken along line V—V of FIG. 3 including a gear for producing needle jogging movements.
Figure 18:
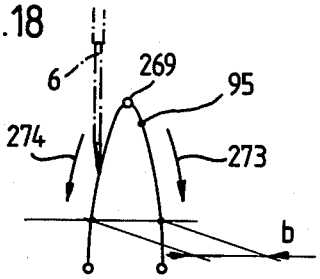
FIG. 18 shows the jogging movement of the needle when sewing tack stitches.
Figure 19:
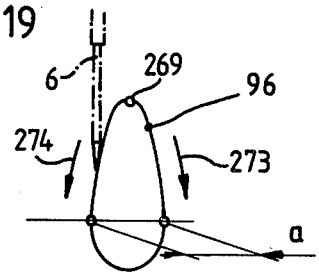
FIG. 19 shows the jogging movement of the needle when sewing fastening stitches.

According to the embodiment 1 the gear 72 comprises a two-step shifting gear 73 which will be explained in conjunction with FIGS. 5, 6 and 7 as follows:

The shifting gear 73 is provided with a gear wheel 75 which is mounted to the arm shaft 58 by means of a set screw 74. A hollow shaft 77 installed with bearings 76 is pivotally received on the arm shaft 58, which furthermore receives a collar 78 axially securing the hollow shaft 77 in connection with the gear wheel 75. The hollow shaft 77 is formed with a stud 79, an eccentric 80, a shoulder 81, a reduced part 82, a large gear wheel 83 and a gear wheel 84 pressed onto a shoulder 85. The eccentric 80 pivotally receives a pitman 86 which is axially supported by means of the shoulder 81 and a disk 89 secured by a pin 87 and a retaining ring 88. Via a pressed-in bolt 91 the pitman 86 is linked at its fork 90 to a crank 92 clamped to the rocking shaft 67, thus forming a mechanism 93, which in conjunction with the eccentric 80 and the arm 57 forms a linkage mechanism 94 producing jogging movements 95 or 96 of the needle 6 (FIGS. 18, 19).

Furthermore, the rocking shaft 67 pivotally receives in bearings 97 an idling gear wheel 98 provided with a small gear wheel 99, a reduced part 100, a gear wheel 101 and a lug 102 formed with a recess 103 cooperating with a shifting fork 104 of a shifting device 105, at which the fork 104 is secured to a shift bar 107 by means of a set screw 106. The shift bar 107 extending in parallel with the arm shaft 58, is slidably received in bearings 108, 109 formed in the arm 57 (FIGS. 3, 5 and 6). The shift bar 60 is installed with a forked end 110 linked to a shift cylinder 112 by means of a bolt 111. The shift cylinder 112 is suspended in a bearing 114 of the arm 57 by a bolt 113.

In a modified version of the embodiment 1 (FIGS. 8, 9 and 10) the linkage mechanism 94 is adjustable and denoted as a shiftable vibrating mechanism 115. Instead of the pitman 86 (FIG. 7) a pitman 116 (FIGS. 8, 9 and 10) is received by the eccentric 80, into the free end 117 of which is pressed a bolt 118 protruding on both sides and pivotally receiving at each side an inner link 119 and an outer link 120. At their free ends the inner links 119 are pivoted to a short bolt 121 of a crank 122 clamped to the rocking shaft 67. The free ends of the outer links 120 are movably supported to bolts 123, which are secured by means of set screws 128 in bores 124 of legs 125, 126 of an U-shaped frame 127. The frame 127 axially secures the inner and the outer links 119, 120 by means of its inner guide surfaces 129.

Figure 10:
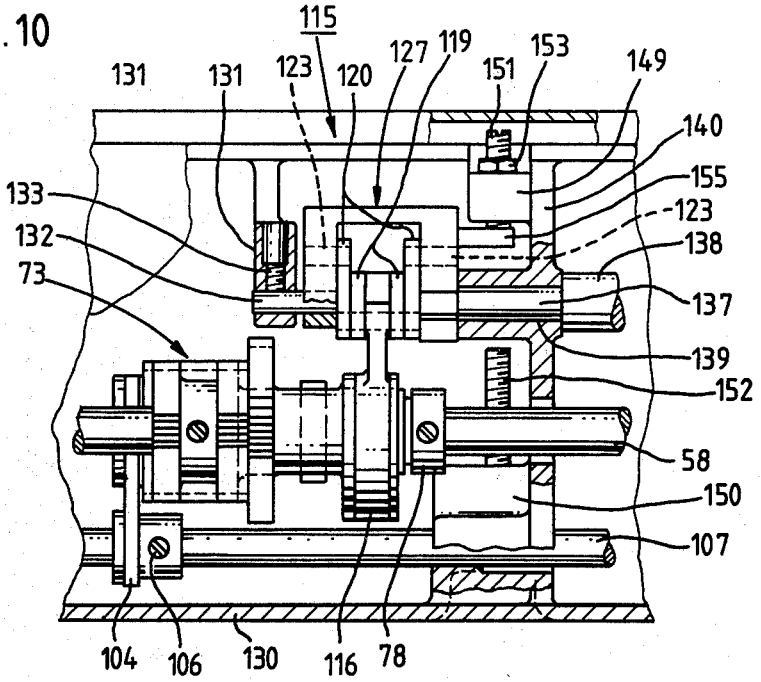
FIG. 10 is a section of the modified gear taken along line X—X of FIG. 8.

As obvious from FIG. 10, the modified arm 57, here denoted as arm 130, is formed with a rib 131, to which a bolt 132 is secured by means of a set screw 133. The bolt 132 projects into a bearing 134 located in the leg 125 of the U-shaped frame 127. The leg 126 of the frame 127 is formed with a bore 135 formed with a clamp 136 which receives the reduced part 137 of an actuating shaft 138 pivoted and axially secured to a bearing 139 of a rib 140 located at the arm 130. The actuating shaft 138 connects the U-shaped frame 127 with a control drive 141 (FIG. 11). The free end 142 of the actuating shaft 138 is clamped to a lever 143 which is drivingly connected to a cylinder 146 by means of a forked part 145 and a bolt 144. The free end 147 of the cylinder 146 is journaled in the arm 130 by a bolt 148.

The rib 140 (FIGS. 8 and 10) is formed with an upper and a lower bearing 149, 150 having threaded bores for receiving an upper and a lower threaded bolt 151, 152, each of which is secured by means of a lock nut 153. Furthermore, the U-shaped frame 127 is formed with a bore 154 receiving a bolt 155 cooperating with the threaded bolts 151, 152 (FIGS. 8, 9 and 10).

Figure 12:
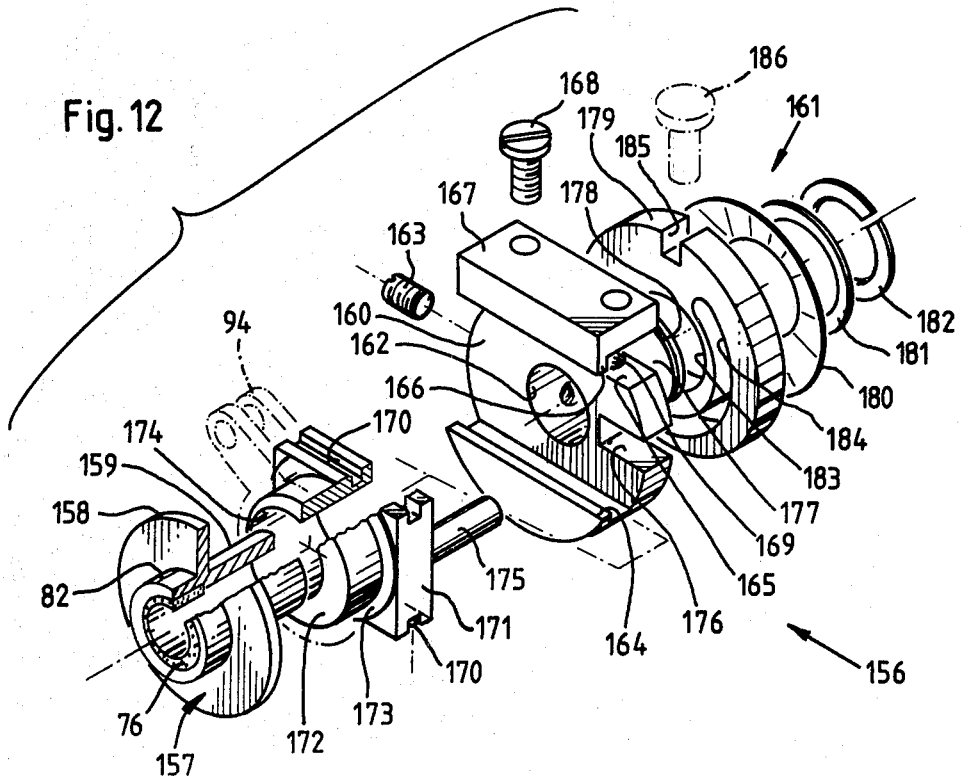
FIG. 12 is a perspective exploded view showing an adjustable eccentric of still another modified embodiment 1.

In still another version of the embodiment 1 the eccentric 80 of the linkage mechanism 94 (FIGS. 6 and 7) is substituted by an adjustable eccentric 156 (FIG. 12). A hollow shaft 157 similarly formed as the hollow shaft 77 (FIG. 7) is provided next to the reduced part 82 with a shoulder 158 and a lug 159 which is received in a bore 162 of a bracket 160 and secured thereto by means of a set screw 163. The bracket 160 is provided with a guide 164 and a surface 165 formed with threads 169 for receiving a guide part 167 by means of screws 168. The guide part 167 is profiled with a guide 166. The guides 164 and 166 engage into grooves 170 of a slide block 171 which is formed with an eccentric 172, a shoulder 173, a bore 174 and a pin 175. The dot-dash-lined pitman of the linkage mechanism 94 is laterally guided by the shoulder 158 and the shoulder 173.

Moreover, the bracket 160 is formed with a slot 176 and a cylindrical part 177 having a recess 178 for movably receiving an adjusting device 161 which comprises an adjusting disk 179, a plate spring 180 and a washer 181 secured by means of a retaining ring 182 resting in the recess 178. The adjusting disk 179 is formed with a bore 183, a spiral groove 184 radially guiding the pin 175. Furthermore, the adjusting disk 179 is profiled with a recess 185 cooperating with an adjusting pin 186 which is movably arranged in the arm 57 or 130 and kept in a non-interfering position by means of a not shown spring.

EMBODIMENT 2

In the embodiment 2 the gear 72 is formed as a shift gear 187 (FIG. 13), at which the vibrating mechanism 93 is provided with a first link mechanism 188 and a second link mechanism 189. The first link mechanism 188 is driven by an eccentric 191 secured to the arm shaft 58 by means of a set screw 190. The eccentric 191 is embraced by a pitman 192 which is axially guided by a shoulder 193 and a disk 196 secured thereto by means of a pin 194 and a retaining ring 195. The pitman 192 is linked at its fork 197 by means of a pressed-in bolt 198 to a first swing element 199 having a bearing 200 pivoted on the rocking shaft 67. The first swing element 199 is formed with a lug 201 having an angular recess 202 and a cutout 203.

The second link mechanism 189 is provided with an eccentric 204 receiving a pitman 205 which is axially guided by shoulder 206 and a disk 207 secured by a pin 208 and a retaining ring 209. As described in conjunction with the first link mechanism 188, a fork 210 of the pitman 205 is connected by a bolt 211 to a second swing element 212 which is formed with a lug 213 having a recess 214 and a cutout 215 similarly profiled as the above described first swing element 199.

The eccentric 204 and a gear wheel 217 are parts of a hollow shaft 216 having two bearings 218 pivoted on the arm shaft 58. The hollow shaft 216 is driven by a drive gear 219 having a ratio of 2:1. The hollow shaft 216 is axially fixed by a gear wheel 220 which is secured to the arm shaft 58 by means of a set screw 221. The gear wheel 220 meshes with a gear wheel 222 meshing with an interposed wheel 223. The latter is idlingly received at its bearing 224 by the rocking shaft 67 and drivingly connected to the gear wheel 217 via a gear wheel 225.

To the rocking shaft 67 there is secured a lever 226 defining an output member and having a hub 227 with a clamp 228 and a rocking lever 229 which is linked to the hub 227 by means of a bolt 230 and provided with a left (231) and a right wedge-shaped lug 232. The free forked end 233 of the rocking shaft 229 is provided with a bolt 234 embraced by a fork 235 of a shift element 236. The shift element 236 is clamped to the shift bar 107 which is displaceably received in the arm 57 (FIG. 3) and forms a shifting device 237.

Figure 13:
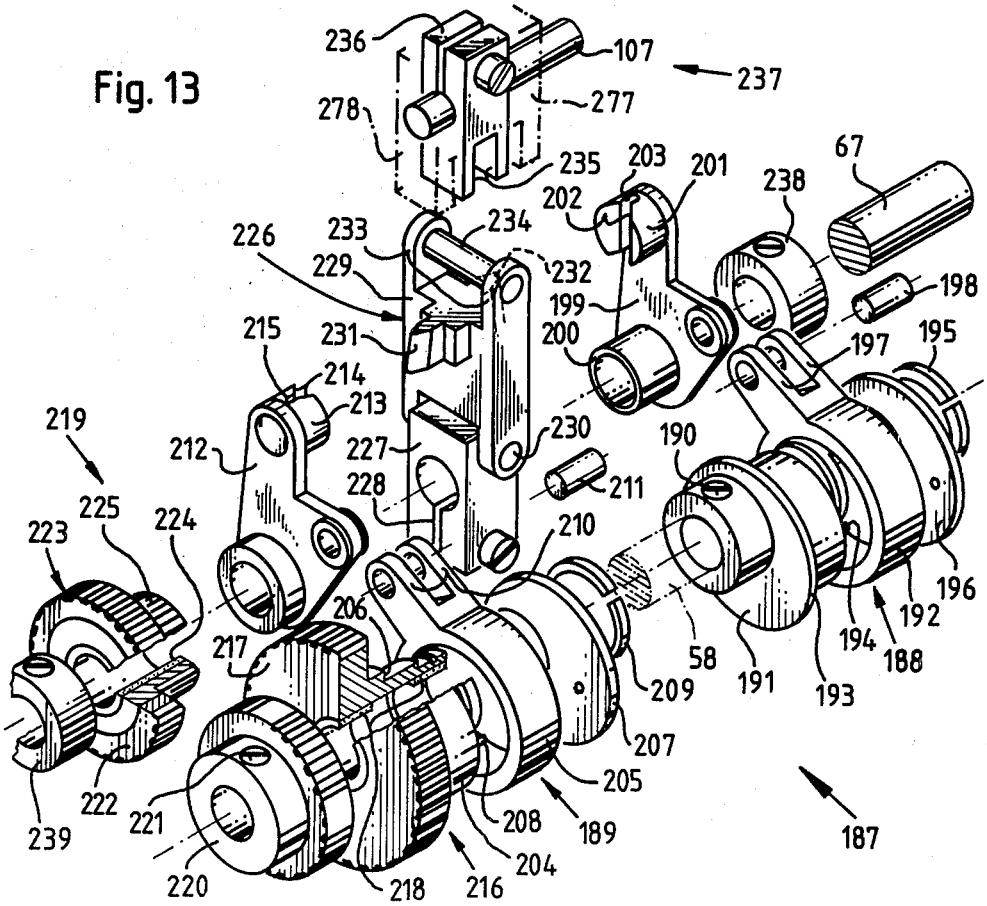
FIG. 13 is a perspective exploded view of the essential parts of the gear according to an embodiment 2.

As illustrated in FIG. 13, the swing elements 199, 212 and the intermediate wheel 223 are axially secured by two collars 238 and 239 mounted on the rocking shaft 67.

EMBODIMENT 3

Figure 14:
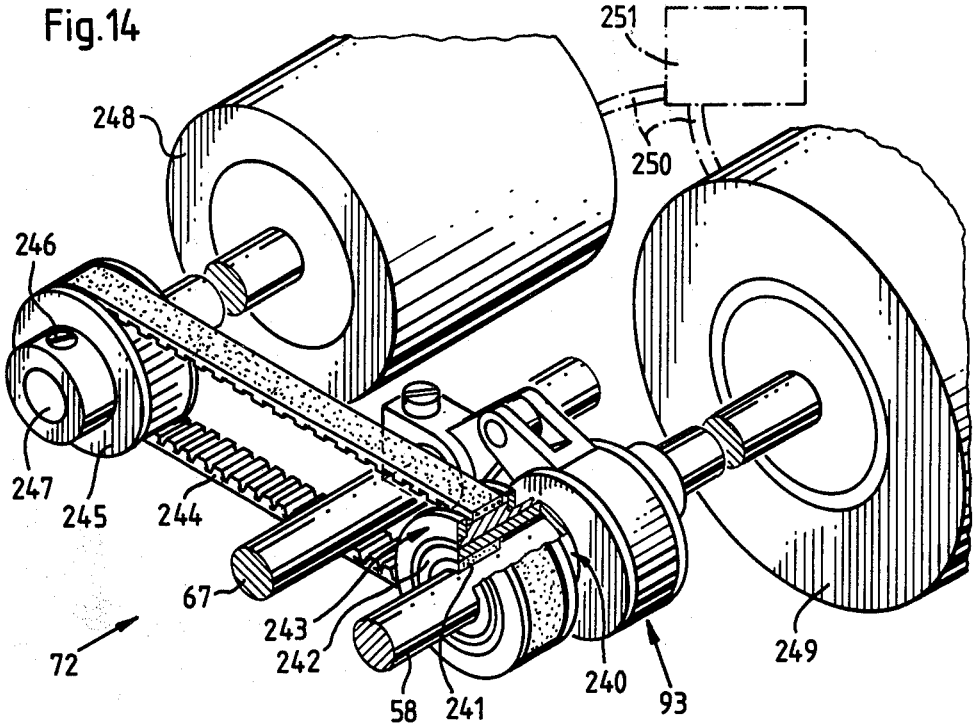
FIG. 14 is a perspective view of an embodiment 3.

According to the embodiment 3 (FIG. 14) a hollow shaft 240 is pivoted in bearings 241 (only one bearing is shown) located at the arm shaft 58. The hollow shaft 240 is formed like the hollow shaft 216 (FIG. 13) however provided instead of the gear wheel 217 with a cylindrical lug 242, onto which a belt pulley 243 with guide disks is pressed. The belt pulley 243 is drivingly connected to a belt pulley 245 by means of a timing belt 244. The belt pulley 245 is secured by a set screw 246 to a shaft 247 of an auxiliary motor 248 mounted to the arm 57. As further illustrated in FIG. 14, the arm shaft 58 is driven by a motor 249. Both motors 248 and 249 are connected to an electrical control 251 via cables 250.

As shown in FIG. 15, another automatic sewing device 252 is installed with a sewing head 254 which includes the above described gear 72 and which is slidably arranged on guide bars 253 as to be moved in the direction of the arrow 256 by means of a linear drive 255. A motor 257 is connected to a shift gear 259 via a belt drive 258 and to the sewing head 254 via a slidable drive connection 260 and a belt drive 261. The shift gear 259 is provided with two shift bars 266, 267 and two rectangularly to each other arranged output shafts 262, 263, the one (262) of which is connected to the linear drive 255 while the other (263) of which is connected to a feeding belt 264 clamping a workpiece 265 to be sewn.

OPERATION

Figure 16:
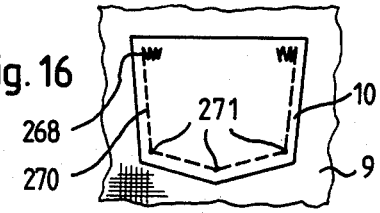
FIG. 16 shows a workpiece cut and a patch pocket sewn thereon by a single seam.
Figure 17:
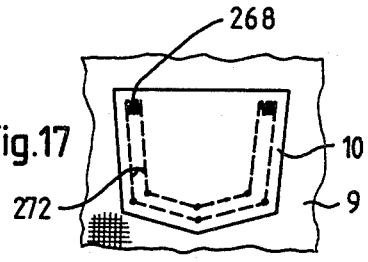
FIG. 17 shows a workpiece cut and a patch pocket sewn thereon by a double seam.

The operation of the automatic sewing device 1 including the gear 72 according to the embodiment 1 will be described with reference to FIGS. 2, 6 and 16 to 19 as follows:

After the clamping plate 11 has clamped the workpiece cut 9 and the pocket cut 10 the sewing head 5 starts to stitch tack stitches 268 (FIGS. 16 or 17). For this purpose, the two-step shifting gear 73 is reversed, at which the idling gear wheel 98 (FIG. 6) is displaced into the dot-dashed position by means of the shifting device 105. Thus, the gear wheels 101, 84 are disengaged as the gear wheels 83, 99 are meshing. The gear ratio changes from 1:1 to 2:1, so that, while sewing, the linkage mechanism 94 imparts to the needle 6 jogging movements 95 (FIG. 18) as zig-zag movements.

When the clutch 54 is engaged, the drive mechanism 50 (FIG. 2) drives the gear 19 via the belt drive 56, so that the control cam 22 will be rotated. The guiding device 17 displaces the workpiece cut 9 together with the pocket cut 10 by means of the grooves 24, 27 cooperating with the cam followers 34, 45, at which the angular position of the clamping plate 11 is controlled by the groove 25 cooperating with the cam follower 43 and the transmission elements inclusive the timing belts 18, 39.

After terminating the tack stitches 268, the sewing head 5 is stopped in needle-upper-position 269 by the switch 30 actuated by the cam 29. Subsequently, the two-step shifting gear 73 will be shifted into the position as illustrated in FIG. 6. Due to the now effective gear ratio of 1:1, the needle 6 will be imparted with the jogging movement 96 (FIG. 19) as needle feed movements while sewing, as the guiding device 17 moves the workpiece cut 9 and the pocket cut 10 for producing fastening stitches 270. As soon as the switch 30 is triggered again by the cam 29, i.e. when reaching the corner 271 of the fastening stitches 270, the sewing head 5 is stopped. After disengagement of the clutch 54, the drive mechanism only acts upon the guiding device 17, at which the workpiece cut 9 including the pocket cut 10 is turned about the needle 6 until the sewing direction is in accordance with the jogging direction 63 of the needle 6 (FIG. 4). After a new actuation of the switch 30, the drive mechanism 50 is inactive, whereas the clutch 54 is engaged again for continuing the sewing cycle. During the further sewing cycle the described steps of operation will repeat and the workpiece cut 9 will be turned step by step into the provided recess 49.

Due to the construction, the allowed angle for turning the workpiece cut 9 about the needle 6 is limited. In this respect, the production of double seams 272 (FIG. 17) requires some more freedome of movement which is given by the shiftable vibrating mechanism 115 according to the modified embodiment 1.

The function of the modified version of the embodiment 1 essentially operates like the described gear 72. The shiftable vibrating mechanism 115 however allows to vary the amplitude "a" or "b" (FIGS. 19 and 18) and the direction of the needle-jogging movement as to cause the needle 6 to perform either jogging movements 96 or 95 in either direction of the arrows 273 or 274. By reversing the vibrating mechanism 115, which is commonly known as a feed controlling mechanism of a standard sewing machine, a reversed stitching is possible too, as to allow even the sewing operation performing the double seam 272 (FIG. 17) although there is restricted freedom for the workpiece's turning movements. In FIG. 8 the reversed position of the shiftable vibrating mechanism 115 is illustrated, at which the U-shaped frame 127 is shown in a dot-dashed position 275. The threaded bolts 151 and 152 assure an independent adjustment of the amplitudes "a" and "b" (FIGS. 19 and 18). Besides reversing of the jogging movements it is possible to bring the bracket 60 (FIG. 4) to a standstill by positioning the U-shaped frame 127 into a O-position 276 (FIG. 8), which for example may be advantageously performed by a three-position cylinder 146 as illustrated in FIG. 11.

The other modifications of embodiment 1 according to FIG. 12 do not change the produceable jogging movements 95 and 96. The arrangement of a known adjustable eccentric 156, which therefore will be briefly described only allows to vary the eccentricity and thus altering the amplitude of vibration "a" resp. "b" (FIGS. 19 and 18). For this purpose, the slide block 171 is movably received in the guides 164, 166 and secured in radial position by means of the pin 175 projecting into the spiral groove 184 of the adjusting disk 179.

In the embodiment 2 (FIG. 13), the first link mechanism 188 imparts to the first swing element 199 a movement corresponding to the jogging movement 96, while, due to the drive gear 219, the second link mechanism 189 imparts to the second swing element 212 an oscillating movement corresponding to the jogging movement 95. The lever 226 secured to the rocking shaft 67 may alternatively be connected by means of the rocking lever 229 to the first (199) or the second swing element 212, at which either the wedge-shaped lug 232 engages the recess 202 or the wedge-shaped lug 231 engages the recess 214. The shifted position is determined by the shifting device 237, the shift element 236 of which may be displaced into position 277 for producing the jogging movement 96 (FIG. 19) or into position 278 for producing the jogging movement 95. During operation of the automatic sewing device 1, the lever 226 swings with its bolts 234 in the fork 235 of the shift element 236.

In the embodiment 3 (FIG. 14) the auxiliary motor 248 drives the vibrating mechanism 93 independently of the arm shaft 58 driven by the motor 249. The electrical control 251 causes the auxiliary motor 248 to follow the motor 249 and also allows to bring the bracket 60 to a standstill in a definite position.

During the sewing cycle of the other automatic sewing device 252 according to FIG. 15, the motor 257 drives the sewing head 254, the gear 7 2 and the shift gear 259. In the shifted position of the gear 259 as illustrated (shift lever 266 in position O and shift lever 267 in position A) the shaft 262 is blocked as the shaft 263 drives the feeding belt 264, so that fastening stitches 280 are produced in the workpiece 265, which is moved in the direction of the arrow 279.

For producing a tack stitch 281 it will be required to stop the automatic sewing device 252 to alter the shift condition of the gear 72 and the shift gear 259, at which the gear ratio of the gear 72 must be altered and shift lever 267 must be positioned in position "B" and shift lever 266 must be positioned in position I. Thus, the shift gear 259 blocks the second output shaft 263 and reverses the direction of rotation of the first output shaft 262, as the gear 72 causes the needle 6 to perform the jogging movement 95 (FIG. 18). Oppositely directed tack stitches 282 may be produced by the shift condition as shift lever 261 in position B and shift lever 266 in position II of the shift gear 259.

What is claimed is:

1. A sewing device for producing fastening stitches (270, 272) and tack stitches (268), having a sewing head (5) including an arm (57), a shaft (58) pivoted in said arm (57) and driving a crank mechanism (59), a needle bar (61) carrying a needle (6) and reciprocately driven by said crank mechanism (59), a bracket (60) receiving said reciprocating needle bar (61) and pivoted in said arm (57) for allowing a lateral swing movement of said bracket (60) in a plane (63) and a jogging means (72) imparting said swing movements to said bracket (60), comprising input drive means (73,191, 219,248) cooperating in an angular relationship with said shaft (58), an output drive element (92; 226) drivingly connected to said bracket (60).

a mechanism (95,115,188, 189) driven by said drive means (73; 191, 219; 248) for producing oscillating movements transmitted to said output drive element (92;226), said oscillating movements relating to said reciprocating needle movements as 1:1 or 1:2, and shifting means (105, 237, 251) for selecting one of said two oscillating movements;

means for receiving a workpiece (9, 10) and control means (17) producing a continuous relative feed movement between said workpiece (9, 10) and said needle (6), comprising means (25,43,42,41,40,39,38,37,18) as to produce said relative movement in direction of said plane (63) while said sewing head (5) produces said fastening stitches (270, 272).

2. A sewing device according to claim 1 wherein said input drive means comprise a shifting gear (73) having a variable gear ratio of 1:1 or 2:1 forming the drive connection between said shaft (58) and said mechanism (94), and a shifting device (105) including a shift drive (112) for putting said shifting gear (73) in either one of said gear ratios.

3. A sewing device according to claim 2, wherein said shifting gear (73) comprises a drive gear (75) fastened to said shaft (58), an idling gear (98) profiled with a first gear (101) forming a 1:1 ratio with said drive gear (75) and with a smaller second gear (99), said idling gear (98) being displaceably pivoted on a rocking shaft (67) parallelly arranged to said shaft (58) and drivingly connected to said bracket (60), and an output drive body idlingly received on said shaft (58) and having a third gear (84) forming a 1:1 ratio with said first gear (101) of said idling gear (98) and a fourth gear (83) forming a 2:1 ratio with said second gear (99) of said idling gear (98), and wherein said shifting means (105) cooperates with said idling gear (98).

4. A sewing device according to claim 1, wherein said mechanism (93; 115; 188, 189) comprises linkage means (94) and a drive eccentric (80; 156).

5. A sewing device according to claim 4, wherein said drive eccentric (156) comprises adjustment means (161) for altering the eccentricity of said drive eccentric (156).

6. A sewing device according to claim 4, wherein said linkage means consists of a linkage mechanism (115) having elements (119, 120, 123, 127) as to allow an alteration of said oscillating movements during the operation including control drive means (141).

7. A sewing device for producing fastening stitches (270; 272) and tack stitches (268) having a sewing head (5) including an arm (57), a shaft (58) pivoted in said arm (57) and driving a crank mechanism (59), a needle bar (61) carrying a needle (6) and reciprocately driven by said crank mechanism (59), a bracket (60) receiving said reciprocating needle bar (61) and pivoted in said arm (57) for allowing a lateral swing movement of said bracket (60) in a plane (63) and a jogging means (72) imparting said swing movements to said bracket (60) and having a shifting gear (73) comprising a drive gear (75) fastened to said shaft (58), an idling gear (98) profiled with a first gear (101) forming a 1:1 ratio with said drive gear (75) and with a smaller second gear (99), said idling gear (98) being displaceably pivoted on a rocking shaft (67) parallelly arranged to said shaft (58) and forming a drive connection to said bracket (60)

an output drive body idlingly received on said shaft (58) and having a third gear (84) forming a 1:1 ratio with said first gear (101) of said idling gear (98) and a fourth gear (83) forming a 2:1 ratio with said second gear (99) of said idling gear (98), a mechanism driven by said shifting gear (73) having a linkage mechanism (115) including elements (119, 120, 123, 127) as to allow an alteration of said swing movements during the operation and control drive means (141) and means (105) for shifting said shifting gear (73) in either one of said gear ratios, means for receiving a workpiece (9, 10) and control means (17) producing a continuous relative feed movement between said workpiece (9, 10) and said needle (6), comprising means (25,43,42,41,40,39,38,37,18) as to produce said relative movement in the direction of said plane (63) while said sewing head (5) produces said fastening stitches (270, 272).

8. A sewing device for producing fastening stitches (270, 272) and tack stitches (268) having a sewing head (5) including an arm (57), a shaft (58) pivoted in said arm (57) and driving a crank mechanism (59), a needle bar (61) carrying a needle (6) and reciprocately driven by said crank mechanism (59), a bracket (60) receiving said reciprocating needle bar (61) and pivoted in said arm (57) for allowing a lateral swing movement of said bracket (60) in a plane (63) and a jogging means (72) imparting said swing movements to said bracket (60) comprising input drive means having a reduction gear (219) of a 2:1 gear ratio and an eccentric (191) fastened to said shaft (58), a mechanism having a first linkage (189) driven by said reduction gear (219) and having a first output element (212) and a second linkage (188) driven by said eccentric (191) and having a second output element (199), a drive element (226) drivingly connected by means (67,69,70,71) to said bracket (60) and shift means (237) to drivingly connect either said first (212) or said second output element (199) to said drive element (226), means for receiving a workpiece (9, 10) and control means (17) producing a continuous relative feed movement between said workpiece (9, 10) and said needle (6) comprising means (25, 43,42,41,39,38,37,18) as to produce said relative movement in the direction of said plane (63) while said sewing head (5) produces said fastening stitches (270, 272).

9. A sewing device according to claim 8, wherein said means drivingly connecting said drive element (226) to said bracket (60) comprise a rocking shaft (67) arranged in parallel to said shaft (58), said reduction gear (219) having an interposed gear body (223) profiled with a large (222) and a small gear (225) and being idlingly received on said rocking shaft, said first (212) and said second output element (199) being idlingly received on said rocking shaft (67), and wherein said drive element (226) is arranged between said first (212) and said second output element (199) and fastened to said rocking shaft (67).

10. A sewing device for producing fastening stitches (270, 272) and tack stitches (268) having a sewing head (5) including a motor (249), an arm (57), a shaft (58) driven by said motor (249) and pivoted in said arm (57)

a crank mechanism (59) connected to said shaft (58), a needle bar (61) carrying a needle (6) and reciprocately driven by said crank mechanism (59), a bracket (60) receiving said reciprocating needle bar (61) and pivoted in said arm (57) for allowing a lateral swing movement of said bracket (60) in a plane (63) and a jogging means (72) imparting said swing movements to said bracket (60) comprising an auxiliary motor (248), a mechanism (93) driven by said auxiliary motor (248) and converting a rotating movement into a swing movement transmitted to said bracket (60) and electrical means (251) controlling said motor (249) and said auxiliary motor (248) as to laterally swing said bracket (60) for effecting a needle feed movement or a zig-zag movement of said reciprocating needle (6), means for receiving a workpiece (9, 10) and control means (17) producing continuous relative feed movement between said workpiece (9, 10) and said needle (6), comprising means (25,43,42,41,40,39,38,37,18) as to produce said relative movement in the direction of said plane (63) while said sewing head (5) produces said fastening stitches (270, 272).

* * * * *